United States Patent [19]

Pretchel

[11] Patent Number: 4,767,352

[45] Date of Patent: Aug. 30, 1988

[54] INTEGRALLY MOLDED CABLE TERMINATION ASSEMBLY, CONTACT AND METHOD

[75] Inventor: David A. Pretchel, Madison, Ohio

[73] Assignee: Minnesota Mining and Manufacturing Company, St. Paul, Minn.

[21] Appl. No.: 900,909

[22] Filed: Aug. 28, 1986

[51] Int. Cl.[4] ..... H01R 4/24

[52] U.S. Cl. ..... 439/395; 439/736

[58] Field of Search ..... 339/97 R, 97 P, 98, 339/99 R, 218

[56] References Cited

U.S. PATENT DOCUMENTS

| | | | |
|---|---|---|---|
| 2,700,206 | 1/1985 | Gilbert . | |
| 2,701,867 | 2/1985 | Obenschain et al. . | |
| 3,274,533 | 9/1966 | Apted et al. . | |
| 3,905,665 | 9/1975 | Lynch et al. . | |
| 3,930,708 | 1/1976 | Wedekind et al. . | |
| 4,030,799 | 6/1977 | Venaleck | 339/99 R |
| 4,094,564 | 6/1978 | Cacolici . | |

*Primary Examiner*—Joseph H. McGlynn

*Attorney, Agent, or Firm*—Donald M. Sell; John C. Barnes

[57] ABSTRACT

A cable termination assembly, and a mold and method of molding the same, includes an electrical cable including at least one conductor, at least one electrical contact, a support body for at least preliminarily supporting the electrical contact, the electrical contact having an insulation displacement connection portion, a contacting portion, and an offset between said portions, and the support body having a land for cooperating with the offset to support the electrical contact during insulation displacement connection connecting of the insulation displacement connection portion to such conductor. Part of the electrical contact and the support body cooperate during the mentioned molding to effect a shut off function blocking flow of molding material of the strain relief into an area of the support body where the contacting portion is located.

9 Claims, 4 Drawing Sheets

INTEGRALLY MOLDED CABLE TERMINATION ASSEMBLY, CONTACT AND METHOD

TECHNICAL FIELD

The present invention relates generally, as indicated, to electrical interconnection devices and methods and, more particularly, to such devices and methods using integral molding. The invention is particularly suited to the field of mass termination connectors.

BACKGROUND

In the art of electrical connectors or electrical interconnection devices for cables and the like, the term cable termination typically means a connector that is or can be used at the end or at an intermediate portion of a cable to connect the conductor or conductors thereof to an external member or members, such as another connector, cable termination, printed circuit board, or the like. Such external member usually is part of or can be connected to at least part of another electrical device, circuit, or the like; in any event, the objective is to effect electrical interconnections of respective circuits, lines, conductors, etc. A cable termination assembly is usually referred to as a combination of a cable termination with an electrical cable. Sometimes the terms cable termination and cable termination assembly equivalently are interchanged, depending on context.

The invention is described in detail below with respect to use of the principles of the invention in a multiconductor cable termination assembly. Such cable termination assembly may be used to connect the conductors of a multiconductor cable, for example, a flat ribbon multiconductor cable (or any other electrical cable) to an external member, e.g., as was noted above. The actual cable termination may take the form of a socket or female connector type structure, a card edge connector, and other forms that are well known, as well as those forms that may be developed in the future.

The discussion below relating to the preferred embodiment of the invention is directed to a multiconductor cable termination assembly. It will be appreciated, nevertheless, that the principles of the invention may be used with a cable having only a single conductor or an assemblage of cables, each having one or more conductors.

Multiconductor electrical cable termination assemblies have been available for a number of years. These cable termination assemblies, in fact, have been available in unassembled form requiring mechanical assembly thereof, which includes the mechanical clamping of the termination properly to secure the various elements of the termination and the cable, and also have been available as a permanent preassembled and molded integral structural combination. Examples of such cable termination assemblies are found in U.S. Pat. No. 3,444,506 and in 4,030,799, respectively.

In both such patents and the techniques disclosed therein, the junctions or connections of contacts with respective conductors of the cable are made by part of the contacts piercing through the cable insulation to engage a respective conductor. Such a connection is referred to as an insulation displacement connection (IDC).

Unfortunately, contamination of the IDC junctions, e.g., due to dirt, corrosion and the like, can detrimentally affect the junctions, e.g., causing a high impedance, an open circuit or the like. The mechanically assembled types of prior cable terminations are particularly susceptible to such consequences. The directly molded cable termination assemblies are less susceptible to contamination because of a molded hermetic seal or near hermetic seal surrounding the junctions of the cable conductors and contacts. Examples of such directly molded cable termination assemblies are presented in the U.S. Pat. No. 4,030,799 and in commonly assigned, concurrently filed U.S. patent application Ser. No. 901,762, for "Improved Jumper Connector", the disclosures of which are hereby incorporated in their entireties.

One common aspect of both the mechanically assembled cable termination assemblies and the directly molded type is the required assembling step or steps and the separate parts fabrications. These are labor and time consuming and, thus, are relatively expensive. For example, the mechanically assembled devices require the separate molding of several parts followed by assembling thereof. Even in the directly molded device of the U.S. Pat. No. 4,030,799, to make a socket connector illustrated therein it is necessary to provide a separately molded cover, to install it over the contacts, and then to secure it, e.g., by ultrasonic welding, to the molded base. It would, of course, be desirable to minimize such mechanical assembly and welding steps and attendant costs. Such elimination of the welding is most desirable because the weld is an area of low strength, and to help assure success of a weld it often is necessary to make the parts of the connector of relatively expensive virgin plastic material.

A number of types of electrical contacts are available for use in electrical connectors. Often the contacts are categorized either as a male contact or as a female contact; and a connector or cable termination using male contacts would be categorized as a male connector while a connector using female contacts would be categorized as a female or socket connector. A typical example of a male contact is that known as a pin contact. A pin contact usually is a relatively rigid straight member that is not particularly compliant relative to a female contact. Pin contacts often are inserted into female contacts to make electrical connections therewith; sometimes pin contacts are inserted into holes in a printed circuit board and usually are soldered in place to connect with printed circuits on the board. Another example effectively of a male contact would be the printed circuit traces or portions on a printed circuit board to which an edge board connector or the like may be connected. A female contact may be of the cantilever type, fork type, box type, resilient wiping type, bow type, and so on. Usually a female contact is relatively resilient and relatively compliant compared to a male contact. When a male contact and a female contact are moved relative to each other or are inserted relative to each other, usually there is some deformation of the female contact in response to engagement with the male contact, and often there is a wiping of the contacts against each other as they are brought together to form an electrical connection therebetween.

One type of female contact, the fork contact, is disclosed in the U.S. Pat. No. 4,030,799. A molding method disclosed in such patent is that which sometimes is referred to as insert molding. For such insert molding method, electrical contacts are placed in a mold, a multiconductor cable is placed relative to the contacts and mold, the mold is closed to effect IDC connections of the cable conductors and contacts and to close the mold cavity, and the molding material then is injected into the mold. The fork contacts mentioned are generally planar contacts in that the major extent thereof is in two directions or dimensions (height and width), and the thickness is relatively small; this characteristic makes the fork contacts particularly useful for insert molding.

Other types of electrical contacts are referred to as three-dimensional contacts. An example is that used in some connectors sold by Minnesota Mining and Manufacturing Company and sometimes referred to as a Hi-Rel contact. Such contact has an inverted U-shape. One leg of the U is connected to a base portion of the contact, which base portion in turn is connected to an IDC portion. The other leg of the U is bent out of the plane of the first leg and base to form a resiliently deformable cantilever contacting portion. The contact ordinarily is placed relative to a socket, cell or chamber into which a pin contact may be inserted to engage the cantilever arm or contacting portion. There are a number of advantages to such three-dimensional contacts, including, for example, the relatively large surface available to engage an inserted pin contact and the relatively large compliance factor allowing a large bending capability of the cantilever contacting portion without overstressing the same.

BRIEF SUMMARY OF THE INVENTION

The present invention enables and represents the merging of advantages, features and components of the insert molding techniques, cable terminations and assemblies with advantages, features and components of the mechanically assembled terminations and assemblies, especially with three-dimensional contacts.

In accordance with the present invention, a multiconductor cable termination assembly junctions between the cable termination contacts and the cable conductors, a housing cover or cap (sometimes referred to as a support body) in which the contacts at least preliminarily are supported, and a strain relief body directly molded to at least part of the cable, contacts, junctions thereof, and cover. Preferably, the junctions are IDC junctions.

Such merging, at least in part, is possible by using a cooperative relation between the contacts and the cover or cap of the cable termination assembly to shut off cells in the cover where working (contacting) portions of the contacts are located. This shut off function allows the strain relief body to be molded directly to the cover, contacts, junctions and cable.

The junctions of such cable termination assembly are secure, the molded strain relief assuring that the contacts and cable are held in relatively fixed positions; and the junctions of the contacts and cable conductors are hermetically sealed within the strain relief body to avoid contamination that otherwise potentially could damage the conductivity or effectiveness of connection. The strain relief body holds the cable, contacts, and cover securely as an integral structure providing a strong cable termination assembly.

Also in accordance with the present invention, a method for making a cable termination assembly includes the initial supporting of one or more contacts in a cover or housing, effecting IDC junction connections between the contacts and respective cable conductors, and molding the strain relief directly to at least part of the cable, contacts, and cover or housing. Importantly, the contacts have a portion intended to cooperate with the cover to provide a shut-off function to block entry of molding material into at least part of the cover during the molding process. This shut-off feature isolates the molded-in end of the contact from the working or contacting end.

Moreover, the contact used in the cable termination assembly includes a number of improvements, for example, to prevent over-insertion of a pin contact into the cable termination assembly and to distribute forces to minimize stress applied to the junctions of the contacts and cable conductors.

The various features of the invention may be used in electrical connectors, primarily of the cable termination or cable termination assembly type, as well as with other electrical connectors. The features of the invention may be used to effect an interconnection of the conductor of a single conductor cable to an external member or to connect plural conductors of a multiconductor cable or assemblage of cables to respective external members. The detailed description below will be directed to a multiconductor cable termination assembly including and for a flat ribbon cable having a plurality of conductors therein. The invention is useful primarily with female-type contacts, socket connectors, card edge connectors, as are described herein; however, the principles of the invention may be employed with contacts other than those of the female type and with other connectors as well.

With the foregoing and following detailed description in mind, one aspect of the invention relates to an electrical connector including at least one electrical contact, a support body for at least preliminarily supporting the contact, and a strain relief body directly molded to at least part of the contact and support body to form an integral structure therewith. Moreover, consistent with this aspect of the invention, another aspect includes the use of an electrical cable with the connector to form a cable termination assembly, the strain relief body being directly molded to at least part of the contacts, cable, and support body.

Another aspect relates to a method of making an electrical connector including placing an electrical contact in the support body portion of the connector, and molding a strain relief body directly to at least part of the contact and the support body, the molding including using at least part of the contact to provide a shut off function with respect to the support body. Such shut off function preferably is accomplished by a cooperative relation of the contact and the support body. Moreover, consistent with this aspect, a further aspect relates to the effecting of an IDC connection between part of the contact and an electrical cable, and the molding including molding material also about at least part of the cable, including the junctions of the contact and cable contactor.

An additional aspect related to a cable termination assembly including at least one electrical contact, a support body for at least preliminarily supporting the contact, the contact having an IDC portion, a contacting portion, and a support offset between such portions, and the support body having a land for cooperating with the support offset to support the latter during IDC connection of the IDC portion to a conductor and preferably also during molding of a strain relief body with respect to the support body, cable and contact.

Still an additional aspect relates to a method of making a cable termination assembly including placing an electrical contact in the support body portion of the assembly, the contact having an IDC portion, a contacting portion, and a support offset between such portions, and supporting the support offset by part of the support body portion while effecting IDC connection of an electrical conductor and the IDC portion.

Yet an additional aspect related to those in the two previous paragraphs includes the direct molding of a strain relief body to at least part of the contact, junction, and support body portion of the assembly forming an integral structure therewith and preferably also forming a hermetic seal about the junctions.

According to a further aspect of the invention, an electrical contact includes a contacting portion for relatively non-permanently electrically connecting with an external member placed relatively with respect to engagement therewith, a terminal portion for relatively permanently connecting with an electrical conductor, whereby the external member and the electrical conductor can be electrically interconnected via the contact, and an offset portion between the contacting and terminal portions for joining of the same. According to further aspects, the offset portion may provide a support function to support the contact relative to a further land or the like during IDC connection to cable conductors; use of the offset to provide a shut off surface during molding of the strain relief body relative to the contact; use of the offset to distribute forces to minimize stress applied to the electrical junctions of the contact terminal portion and such electrical conductor; and use of the offset to block too far insertion of a pin contact or the like to engagement in a cable termination assembly employing the contact of the invention.

The foregoing and other objects, advantages and aspects of the invention will become more apparent from the following description.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENT

Figure 2:
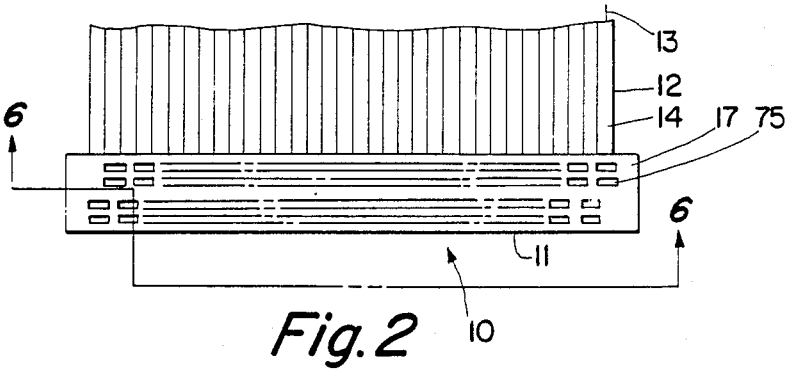
FIGS. 2 and 3 are, respectively, top and bottom views of the cable termination assembly looking in the direction of the respective arrows of FIG. 1.

Referring, now, in detail, to the drawings, wherein like reference numerals designate like parts in the several figures, and initially to FIGS. 1 through 7, a cable termination assembly in accordance with the present invention is designated 10. The cable termination assembly includes a cable termination 11 and a multiconductor flat ribbon cable 12, for example, of conventional type. Such cable 12 includes a plurality of electrical conductors 13 arranged in a generally flat, spaced-apart, parallel-extending arrangement and held relative to each other by the cable insulation 14. The conductors may be copper, aluminum, or other conductive material. The insulation 14 may be polyvinyl chloride (PVC) or other material capable of providing an electrical insulation function desired. It will be appreciated that although the cable is shown as a multiconductor cable, principles of the invention may be employed with a single conductor cable. Moreover, although the multiconductor cable preferably is in the form of a flat ribbon cable, the cable configuration may be of other style, and, in fact, the multiconductor cable may be formed of a plurality of single conductor cables assembled together.

The cable termination assembly 10 is capable of effecting a mass termination function for the plurality of conductors 13 in the multiconductor cable 12.

The fundamental components of the cable termination assembly 10 include the cable termination 11 and cable 13 and the cable termination 11 includes a plurality of electrical contacts 15, a cap 16, and a strain relief 17. The cap 16 serves as a preliminary support for the contacts 15 prior to molding of the strain relief body 17. The cap 16 also provides a plurality of cells 20 to guide pin contacts or the like for engagement with respective contacts 15 and to help support the electrical contacts 15 for such engagement. The electrical contacts 15 are electrically connected relatively permanently to respective conductors 13 of the cable 12 at respective insulation displacement connection (IDC) junctions 21; and the electrical contacts 15 also include a portion for relatively non-permanently connecting with another member, such as a pin contact, that can be inserted to engage and can be removed from engagement with respect to the electrical contact. The strain relief body 17 is directly molded about part of the contacts 15, part of the cap 16, and the junctions 21 to form therewith an integral structure as is described further below.

Figure 1:
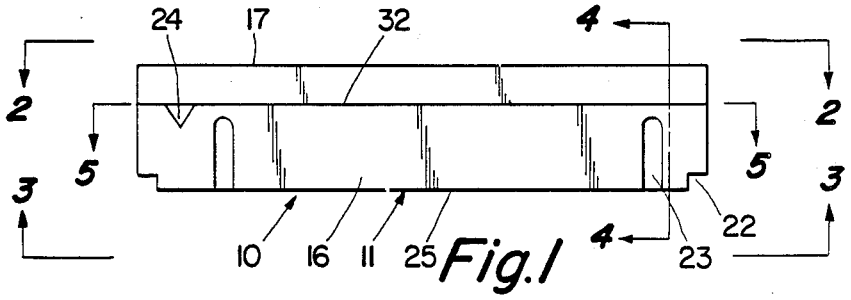
FIG. 1 is a side elevation of a cable termination assembly in accordance with the present invention.
Figure 3:
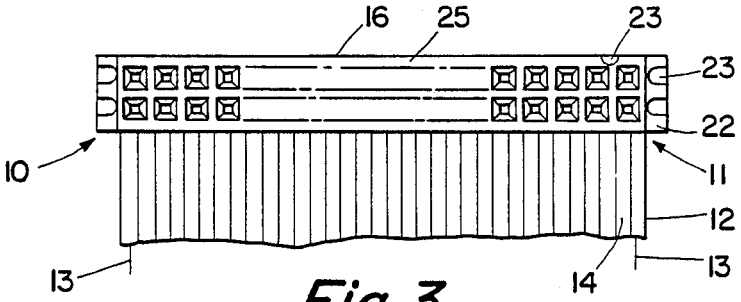

Details of the cap 16 are illustrated in FIGS. 1 through 12. The cap preferably is formed by plastic injection molding techniques. The material of which the cap is made may be plastic or other material that can be plastic injection molded, such material may include glass fiber material for reinforcement, as is well known. Various steps, polarizing, keying, etc., means may be provided at the outer surface or surfaces (or elsewhere) in the cap 16. For example, a step 22, a slot 23, and a pin 1 for angular indicator 24 are illustrated in FIG. 1 for such purposes.

Within the cap 16 are formed a plurality of cells 20. Such cells or chambers 20 are formed in such a way as to provide desired support and positioning functions for the contacts 15 and to guide a pin contact or other external member into the cell for making an electrical connection with the contacts 15 therein. At the front end 25 of the cap 16 are tapered holes or openings leading into the contacting area 27 of each cell into which a pin contact can be inserted for electrical connection with a respective electrical contact 15. Such electrical connection ordinarily is non-permanent, especially relative to the permanency of the IDC junctions 21, in that in the usual case it is expected that the pin contact could be withdrawn from the cell 20.

Each cell 20 includes both the contacting area 27, a positioning area 30, and a land support 31. The contacting area 27 is where a pin contact may be inserted to engage the electrical contact 15. The positioning area 30 helps properly to position the contact 15 in the cell 20 for the further steps described below in manufacturing the cable termination assembly 10 and for proper orientation of the contact 15 for subsequent use of the cable termination assembly 10. The land support 31 provides a contact support function described in greater detail below.

Referring specifically to FIGS. 8–11, details of the cap 16 are specifically illustrated. The contacting area 27 of each cell 20 extends fully between the front 25 and the back 32 of the cap 16. The positioning area 30 of each cell extends from a location adjacent a land 33 relatively proximate the front 25 (but just behind the juncture of the tapered opening 26 with the contacting area 27) to the back 32 of the cap 16. For purposes of this description, the length of each cell is the vertical direction with respect to FIG. 8; the width of each cell is the horizontal direction depicted in FIG. 8, and the thickness of each cell is the dimension into or normal with respect to the plane of the paper relative to the illustration of FIG. 8. The thickness and width of the contacting area 27 are approximately equal to form a generally square cross-sectional area normal to the height of each contacting area 27 of each cell 20. The width of the positioning area 30 is about the same as the width of the contacting area 27. However, the thickness of the positioning area 30 is smaller than the thickness of the contacting area so as to provide a relatively close fit for part of the contact 15 to accomplish the desired positioning function, as will be described further below.

Figure 9:
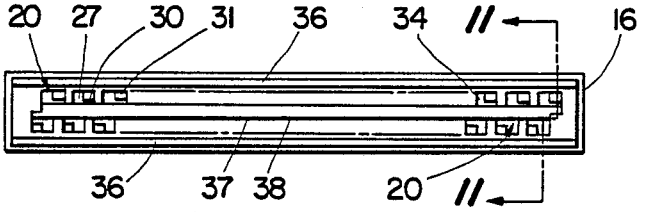
FIGS. 9 and 10 are, respectively, top and bottom views of the cover of FIG. 8 looking generally in the direction of the respective arrows thereof.
Figure 11:
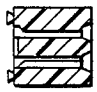
FIG. 11 is a sectional view of the cover looking in the direction of the arrows 11—11 of FIG. 9.
Figure 8:
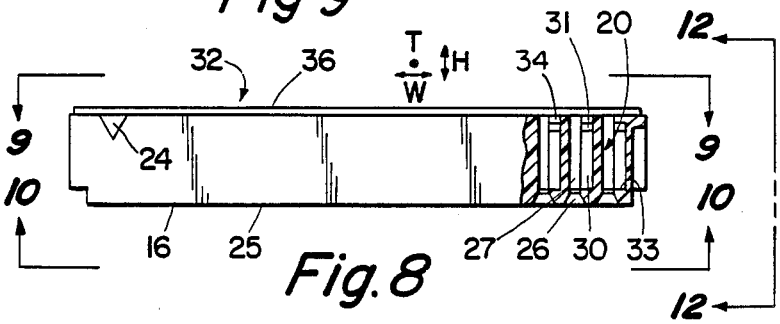
FIG. 8 is a side elevation of the cover for the cable termination assembly, the right-hand portion of the figure being broken away in section.

At the back 32 each cell 20 has a relatively large rectangular opening 34 (FIGS. 9 and 11). The land 31 slopes to provide a gradual lead in from the thick area of such opening 34 in line with the positioning area 30 to the relatively thinner part of such positioning area 30. As is seen in FIG. 11, for example, such land 31 is the start of a rib 35 that extends to the land 33 adjacent the opening 26 to each cell 20.

Figure 12:
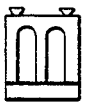
FIG. 12 is an end view of the cover looking in the direction of the arrows 12—12 of FIG. 8.
Figure 10:
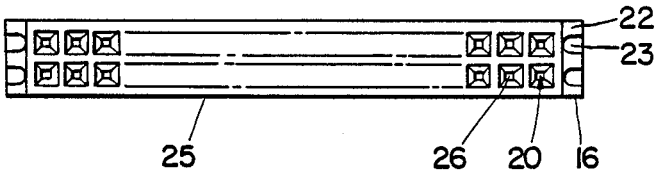
Figure 16:
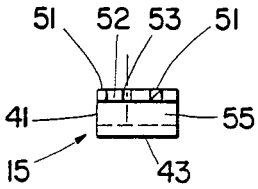
FIGS. 16 and 17 are, respectively, top and bottom views of the contact of FIG. 13 looking generally in the direction of the respective arrows.

At the back 32 of the cap 16, are a pair of ribs 36, which extend along the width of the cap. The ribs have a slightly tapered cross section as is seen in FIGS. 11 and 12, for example, being relatively thin proximate the back 32 of the cap and relatively thicker more remote from the back 32. The strain relief body 17 is molded directly to the back end 32 of the cap 16, and such molding material tends to knit with such ribs 36 and to hold thereto due to the mentioned tapered cross section of the ribs. The cells 20 are arranged in the preferred embodiment and best mode of the invention in dual-in-line presentation, and a divider wall 37 separates the respective rows of cells. The divider wall 37 extends to the front end 25 of the cap 16 but is recessed at the back end 32, as is seen, for example, at 38 in FIGS. 9 and 11. Such recess 38 in the wall 37 further provides for the flow of plastic therein during molding of the strain relief body 17 to assure secure attachment of the strain relief body and the cap 16.

An advantage to the cap 16 of the present invention and to the overall cable termination assembly 10 is that although the cap 16 is a relatively complex part that requires a relatively complex mold in order to effect plastic injection molding thereof, such molding of a complex part is relatively inexpensive and efficient after the mold has been made because only plastic is molded. Insert molding is unnecessary. The contacts 15 themselves are not molded as part of the cap 16. Moreover, since the cap 16 is formed with relatively complex surfaces, the contacts 15 may be relatively uncomplicated, and this further reduces cost of the cable termination assembly 10.

As will become more apparent from the description below, the cap 16 provides a number of functions in accordance with the present invention. For example, the cap, which also may be considered a cover or a housing, covers or houses part of each of the contacts 15. The cap 16 also provides a positioning function cooperating with the contacts 15 to assure proper positioning thereof both for purposes of manufacturing the cable termination assembly 10 and for use thereof. In connection with the method for making the cable termination assembly 10, the cap 16 temporarily provides a support function serving as a support body for the contacts both during the insulation displacement connection step at which time the junctions 21 are formed and during the molding of the strain relief body 17. The cap 16 also provides guidance for external members, such as pin contacts, which are inserted into cells 20 and cooperates with the contacts 15 to avoid over-stressing of electrical contacts 15. Furthermore, since part of the contacts directly engage surfaces in the cap 16, such as within the positioning area 30 and at the support land 31, and since part of the contacts engage the molded strain relief 17, as is illustrated and described herein, forces applied to the contacts are relatively well distributed or spread out in the cap and strain relief. Such forces may be imposed by the insertion or withdrawal of a pin contact relative to a cell 20 and contact 15 therein; and such force distribution helps to minimize any damaging impact of the force on the contact 15 itself and/or on the junction 21 thereof. These and other functions of the cap 16 will be evident from the description herein.

Referring to FIGS. 13–18, the electrical contact 15 is illustrated in detail. Preferably, each of the electrical contacts 15 is the same.

Electrical contact 15 includes an IDC terminal portion 40, a base 41, a support leg 42, a cantilever support 43, and a cantilever contacting portion 44. The contact 15, and other identical contacts, may be die cut from a strip of material, and such contacts may be carried by a carrier strip 45 attached at a frangible connection 46 to the contacts in a manner that is well known. The carrier strip 45 is connected to the back end 47 of the contacts proximate the IDC terminal portion 40. The cantilever support 43 is at the front end 48 of the contact 15, and the cantilever contacting portion 44 extends from such cantilever support 43 partly toward the back end 47 terminating prior to reaching the base 41. The contact 15 may be die cut or otherwise cut from strip material, such as berylium copper material, and the various bends and curves in the contact may be formed by stamping the same using generally conventional techniques.

At the back end 47 of the contact 15, the IDC terminal portion 40 may be of relatively conventional design. Such portion 40 includes, for example, a pair of generally parallel legs 50 having pointed tips 51 and sloped surfaces 52 leading to a groove 53 between the legs. The pointed tips 51 may be used to facilitate penetrating the insulation of a cable, and the sloped surfaces 52 guide the cable conductor into the groove 53 for engagement with legs 50 to form an electrical junction 21 therewith.

The base 41 is relatively wider than the IDC terminal portion 40 and has primarily three functions. One of those functions is the joining of the IDC terminal portion 40 and the working end 54 of the contact. The working end 54 includes the support leg 42, cantilever support 43, and cantilever contacting portion 44. The other very important function of the base 41 is to cooperate with the side walls of the opening 34 at the back of each cell 20 to shut off the forward portion of the cell blocking the flow of plastic into the latter during the molding of the strain relief body 17. Accordingly, such base provides a shutoff for the cap at the respective cells 20 to prevent the molded strain relief material from interfering with the working end 54 of the contact. A third function of the base 41 is to limit maximum insertion of a pin contact into a cell 20 to prevent such pin contact from being inserted too far into the cell and creating damage to the mechanical structure of a cable termination assembly and/or causing a short circuit with a conductor 13 of the cable 12.

Consistent with and enabling performance of the aforementioned functions, the base 41 includes an offset or bend 55. Due to such offset 55 and to the bending of the cantilever contacting portion 44 out of the plane of the support leg 42 and cantilever support 43, in particular, the contact 15 is considered a three-dimensional contact (this as opposed to the generally planar nature of a conventional fork contact disclosed in the '799 patent mentioned above).

Figure 13:
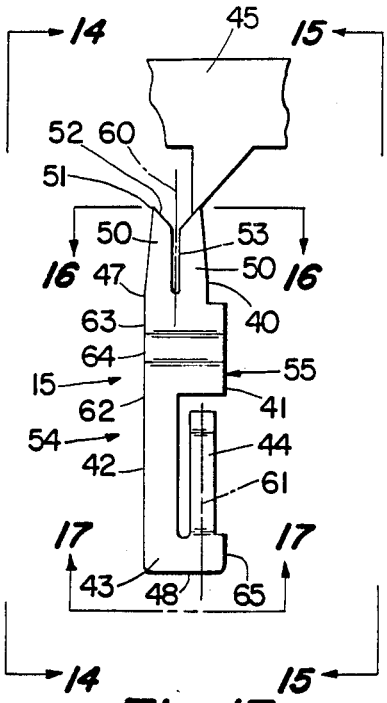
FIG. 13 is a front elevation of an electrical contact for use in the cable termination assembly of the invention, such electrical contact being shown supported from a breakaway carrier strip.
Figure 18:
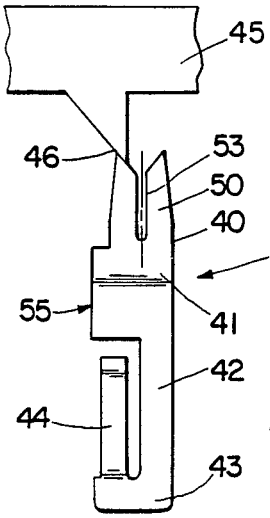
FIG. 18 is a back elevation of the contact of FIG. 13.
Figure 17:
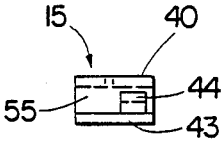

A generally U-shape configuration is defined by the support leg 42, cantilever support 43 and cantilever contacting portion 44, as is seen in FIGS. 13 and 18, for example. The support leg 42 extends generally linearly from the base 41 but preferably is generally coparallel or coaxial with respect to the linear extent of the IDC terminal portion 40. Such coparallel extent, though, is not a restriction on the contact, and the support leg 42 may be bent to extend non-linearly or otherwise, depending on circumstances and desired use. Nevertheless, the linear extent is preferred in order to facilitate insertion, retention, and positioning relative to the linear extending positioning area 30 in a cell 20 of the cap 16. For the same reasons, the cantilever support 43 preferably extends in generally coplanar relation to the support leg 42.

Figure 14:
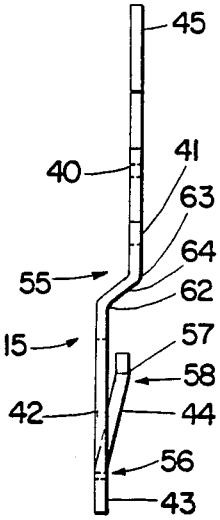
FIGS. 14 and 15 are, respectively, left and right end views of the contact of FIG. 13 looking generally in the direction of respective arrows.
Figure 15:
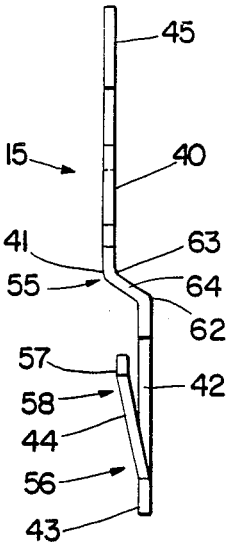

On the other hand, the cantilever contacting portion 44 is bent to extend in cantilever relation out of the plane of the support leg 42 and cantilever support 43, as is seen in FIGS. 14 and 15, for example. The cantilever contact portion 44 is bent relative to the plane of the cantilever support 43 at a bend 56. A further bend 57 defines a contacting area 58 of the cantilever contacting portion 44 where actual electrical connecting engagement is made with a pin contact or other external member inserted into a cell 20 of the cable termination assembly 10, as is seen in the illustration of FIG. 20, for example.

Figure 4:
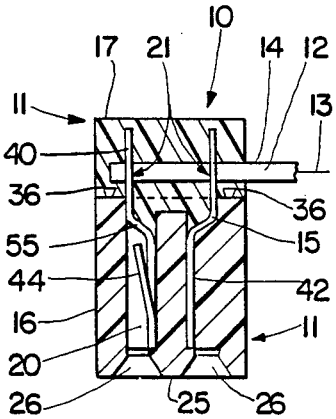
FIG. 4 is a sectional view looking generally in the direction of the arrows 4—4 FIG. 1.
Figure 5:
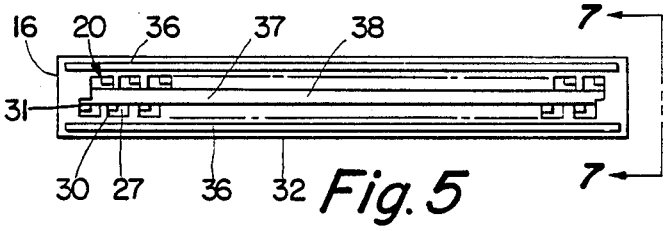
FIG. 5 is a section view of the cable termination assembly of FIG. 1 looking generally in the direction of the arrows 5—5, the contacts themselves not being shown.
Figure 7:
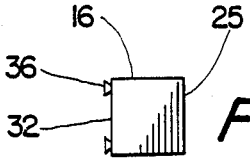
FIG. 7 is an end elevation of the cover for the cable termination assembly.

The IDC terminal portion 40 is offset relative to the cantilever contacting portion 44, as is seen in FIG. 13, for example. The extent of such offset is represented by the relation of axis line 60 through the center of the groove 53 to the axis line 61, which is drawn along the center of the cantilever contacting portion 44. Such offset relation facilitates relatively closely packing the contacts 15 and use thereof with relatively close-packed or closely positioned conductors 13 in a dual-in-line cable termination assembly arrangement, as is described, for example, in the above-mentioned U.S. Pat. No. 4,030,799. Thus, for example, with the contacts 15 that are adjacent to each other but are in opposite rows of the dual-in-line arrangement as is illustrated in FIG. 4, the IDC terminal portion 40 of one of those contacts would form an electrical junction 21 with one of the conductors 13, and the other of the two contacts illustrated in the cable termination assembly 10 of FIG. 4 would form a junction 21 with a conductor that is immediately adjacent to the previously-mentioned conductor 13; and so on.

Figure 19:
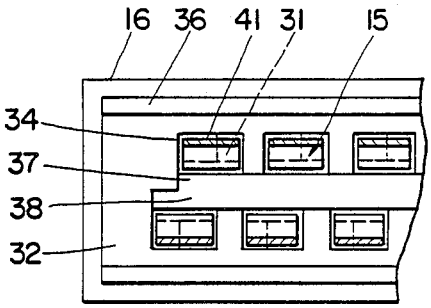
FIG. 19 is an enlarged fragmentary top view of the cover similar to the illustration of FIG. 9 but also showing a top section view of the installed electrical contacts.
Figure 20:
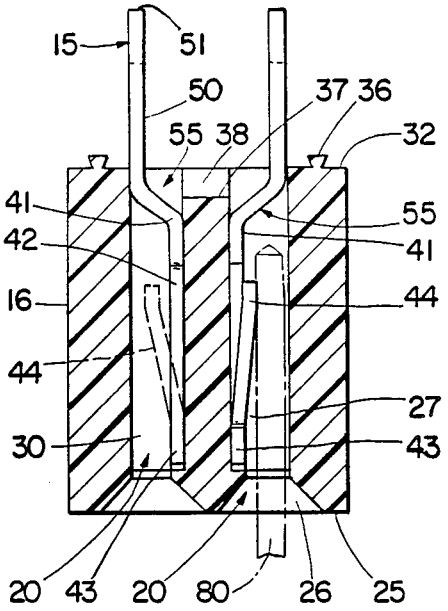
FIG. 20 is an enlarged sectional view of the cover with contacts installed, one contact being resiliently deformed by an inserted pin contact.

A sub-assembly of electrical contacts 15 and the cap 16 prior to molding of the strain relief body 17 thereto is illustrated in FIGS. 19 and 20. To assemble such sub-assembly the contacts 15 are inserted into respective cells 20 of cap 16. Such insertion may be facilitated by allowing the plurality of contacts 15 to remain fastened to the carrier strip 45 so that an entire row of contacts may be inserted into an entire row of cells 20, after which the carrier strip 45 may be broken away at the frangible connection 46 and discarded.

To insert a contact 15 in a cell 20, the cantilever support 43 is aligned with the opening 34 at the back of a cell such that the support leg 42 is aligned to slide into the positioning area 30 and the cantilever contacting portion 44 is aligned to slide into the contacting area 27 of the cell. The offset arrangement of the cells 20 in the two rows thereof formed in the cap 16 and the offset 55 at the base 41 of each contact help to assure that the spacing of the IDC terminal portions 40 of the contacts in one of the two parallel rows thereof are relatively far from the IDC terminal portions 40 of the contacts in the other row, as is seen in FIGS. 4 and 20, for example. This arrangement helps to assure maximum integrity of the insulation 14 of the cable 12 and proper connections of the contacts 15 to respective conductors 13 of the cable 12. Such spacing also helps to assure flow of plastic molding material with respect to the cable 12, contacts 15, and cap 16 to achieve secure integral connection of such parts and encapsulation and hermetic sealing of the junctions 21.

Further insertion of the contact 15 into a cell 20 will place the front end 47, and, in particular, the leading end of the cantilever support 43 into, engagement with the land or relatively proximate the land 33 at the front end of the positioning area 30 of the cell 20. Importantly, upon full or substantially full insertion of the contact 15 with respect to a cell 20 places part of the offset or bend 55 of the contact base 41 in direct confronting engagement with the sloped surface of the support land 31. Preferably, the offset 55 in the contact base 41 is formed by a pair of obtuse angles 62, 63 coupled by a linear extent 64 of the base 41. Such obtuse bends ordinarily will encounter relatively smaller stress in the material of the contact than right angle bends; and this helps to assure the integrity and longevity of the contact. The shape of the support land 31 preferably is configured to fit relatively closely in engagement with the offset 55 of the contact base 41 and is, accordingly, sloped at the same angle at which the offset 55 is sloped, as is depicted in FIGS. 4, 15, and 20, for example. The close fit and engagement of the contact 15 at the offset 55 and support land 31 enables the latter to support the contact during the insulation displacement connection process described further below and to distribute stress. Moreover, the relatively close fit of the contact support leg 42 and cantilever support 43 in the cell 20 further helps assure correct positioning and support for the contacts during such IDC step and during molding of the strain relief body 17 and to distribute stress.

Importantly, the base 41, and, more particularly, the area of the offset 55 thereof, fits rather closely in the opening 34 at the back of the cell 20, as is seen, for example, in FIG. 19. The area of the offset 55 and/or part of the contact base 41 substantially completely fills the opening 34 of a cell and the amount of clearance between the edges of the contact 15 and the side walls of such opening 34, as viewed in FIG. 19, is adequately small so that the flow of plastic beyond the offset 55 into the cell 20 will be blocked. For example, such clearance between the offset 55 and the walls defining the opening 34 to each cell may be on the order of from about 0.001 to about 0.002 inch. Such clearance is adequately small ordinarily to prevent the flow of plastic down into the cell 20 during molding of the strain relief body 17.

Furthermore, due to the relatively close fit of the offset 55 relative to the walls of the opening 34, the relatively close fit of the support leg 42 in the positioning area 30 of the cell 20, and the width of the cantilever support 43 of the contact, including the overhang 65 thereof, and the engagement of the support land 31 with the offset 55, such contacts will be held relatively securely both during the IDC step and the injection molding step described further below and will have forces applied to the contacts distributed into the cap 16 and strain relief body 17.

Figure 21:
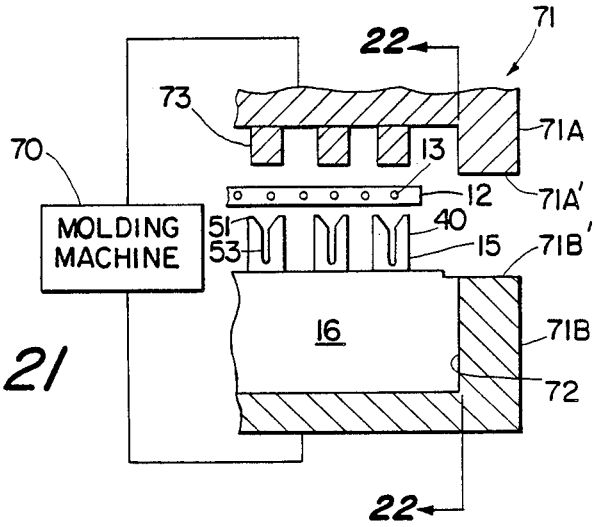
FIGS. 21 and 22 are, respectively, partial schematic front and end views of a molding machine for making cable termination assemblies according to the invention.
Figure 22:
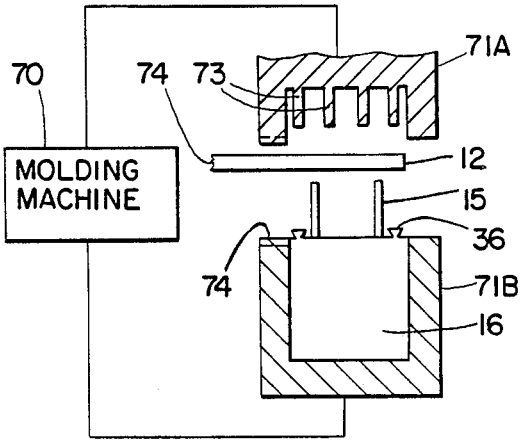

Turning to FIGS. 21 and 22, the apparatus and method for making the cable termination assembly 10 are illustrated. The apparatus is in the form of a molding machine generally designated 70, which includes a mold 71 having an A half 71A and a B half 71B. The mold half 71B has a recess or cavity 72 into which the cap 16 of the cable termination assembly 10 may be placed in relatively close-fitting relation. Preferably, such close fit prevents flow of plastic into the B half of the mold 71 about the sides and ends of the cap. The contacts 15 are installed in the cap 16 either before the cap is placed in the mold half 71B or afterwards. Such contacts are inserted fully into the respective cells 20 to the positions illustrated, for example, in FIGS. 4, 6, and 20 to complete the sub-assembly of the contacts 15 and cap 16 described above. The IDC terminal portions 40 of the contacts 15 are exposed for insulation displacement connection with respective conductors 13 of the cable 12 upon closure of the mold 71. In FIG. 21 the illustration is simplified by showing only the contacts 15 in one of the rows of a dual-in-line arrangement otherwise illustrated and described in this application. Both rows of contacts are illustrated in FIG. 22, though.

The cable 12 is positioned relative to the IDC terminal portions 40 of the contacts 15 to align the respective conductors above the IDC slots 53, as is seen in FIG. 21. Thereafter, the mold 71 may be closed using hydraulics or other power source of the molding machine 70, bringing the A half 71A and the B half 71B together. As the mold is closed, respective pairs of cores 73 tend to urge the cable 12 toward the IDC terminal portions 40 to force the pointed tips 51 to pierce through the cable insulation 14 and also to force the conductors 13 into respective IDC grooves 53 to make effective electrical connections or junctions between each conductor and a respective contact. During such closure of the mold 71 effecting the mentioned IDC function, the contacts 15 are held relatively securely in the relative positions illustrated in the drawings by the cap 16. The arrangement of cores 73 is seen more clearly in FIG. 22. Each pair of cores 73 presses the cable down toward the aligned respective IDC terminal portion 40 of a given contact. The two cores forming a pair thereof aligned with a respective contact preferably are adequately spaced to allow flow of molding material therebetween as the strain relief body 17 is molded to encapsulate the junction 21.

Grooves at one side of one or both of the A and B halves of the mold are designated 74. Such grooves facilitate passage of the cable 13 between the mold halves when the halves are closed while a tight fit of the mold halves with the cable is made to prevent leakage of molding material during the molding of the strain relief body 17.

With the mold 71 closed a mold cavity is formed bounded in part by the mold halves 71A, 71B and by the back end 32 of the cap 16 and contacts 15 sub-assembly. The molding machine 70 injects plastic or other molding material (which, if desired, may include glass or other reinforcing or filling material) into the mold cavity to form the molded strain relief body 17. Such molding material flows about at least part of the cable, about the IDC terminal portion of the contacts 15, about the junctions 21 of the conductors 13 and contacts 15 (the molding material, accordingly, flowing between the various core pairs 73, as is described in the above-mentioned concurrently filed patent application for "Improved Jumper Connector"), and the molding material flowing further about the knit ribs 36, into the recess 38, and to a limited extent, as permitted by the location of the offset bends 55 of the contacts 15 into part 75 (FIG. 4) of the openings 34 of the cells 20.

Upon solidification of the molding material 17 or other curing thereof, the same forms with the cable 13, contacts 15, and cap 16 a substantially integral structure of the cable termination assembly 10. The mold 71 then may be opened to withdraw the cores 73 (leaving the recesses 75 seen in FIG. 2 in the back end of the strain relief body 17) while the junctions 21 remain substantially fully encapsulated and in hermetically sealed relation within the molded strain relief body 17. The cable termination assembly 10 then may be removed from the mold 71, for example, by withdrawing the cap 16 from the recess 72 and the mold half 71B.

According to the preferred embodiment, the material of which the strain relief body 17 is molded and that of which the cable insulation 14 is formed are compatible so that the two chemically bond during the molding step described. Also, preferably the material of which the strain relief body 17 is molded and that of which the cap 16 is made are the same or are compatible to achieve chemical bonding thereof during such molding step described. Further, the temperature at which molding occurs preferably is adequately high to purge or otherwise to eliminate oxygen and moisture from the areas of the junctions 21. Such oxygen-free and moisture-free environment preferably is maintained by a hermetic seal of the junctions 21 achieved by the encapsulation thereof in the strain relief body 17 and helps to prevent electrolytic action at the junctions; therefore, interaction or reaction of the materials of which the conductors 13 and contacts 15 are made, even if different, will be eliminated or at least minimized.

It will be appreciated that the above-described method of making the cable termination assembly 10 effects facile mass termination of the conductors of a multiconductor cable. Since the strain relief body 17 is molded directly to the cap 16, there is no need separately to fasten a cap to a molded strain relief body, e.g., by ultrasonic welding, or the like, as is described in the U.S. Pat. No. 4,030,799. Furthermore, since there is no need to effect a separate ultrasonic welding function, relatively less expensive materials, such as re-grind or those including re-grind materials, can be used to make the cap 16 and strain relief body 17, thus reducing the cost for the cable termination assembly 10.

Additionally, it should be understood that the parts of the invention and the method described above enable the IDC step and the molding of a strain relief body essentially to be carried out as part of the same process in making a cable termination or cable termination assembly that uses a three-dimensional contact.

Figure 6:
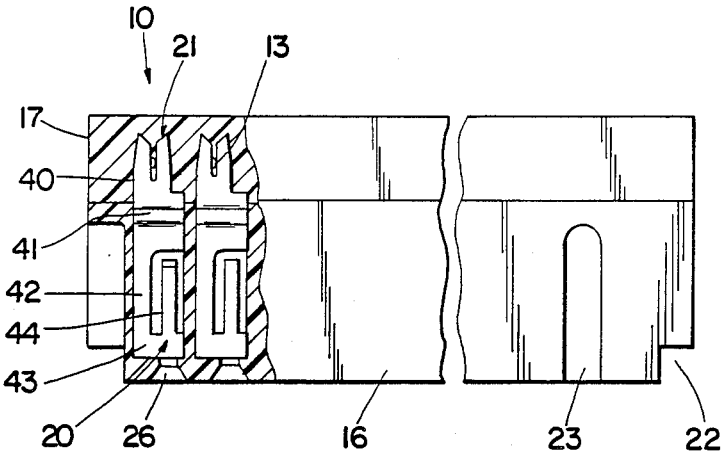
FIG. 6 is a partial side elevational view partly in section looking generally in the direction of the arrows 6—6 of FIG. 2.

In using the cable termination assembly 10 of the invention, as is illustrated in FIGS. 4, 6, and 20, for example, an external member, such as a pin contact 80 (FIG. 20) may be inserted into the opening 26 of one of the cells 20 (or a plurality of such pin contacts or other external members can be inserted simultaneously into respective cells 20). During such insertion the leading end of such contact 80 engages the cantilever contacting portion 44 of a contact 15 and tends to push the same slightly out of the way permitting further insertion of the pin contact. The cantilever contacting portion deforms resiliently and tends to wipe against the surface of the inserted pin contact 80 to form a good electrical connection therewith. Such wiping may effecting a cleaning of the surfaces of the contacting area 58 of the cantilever contacting portion 44 and the confronting surfaces of the pin contact 80 further to enhance the effectiveness of the electrical connection therebetween.

A feature of the three-dimensional cantilever contact 15 and cooperation thereof with the wall 37 of the cap 16 is that excessive deformation of the cantilever contacting portion 44 by a pin contact 80 cannot bend the cantilever contacting portion beyond engagement thereof with the wall 37; this prevents over-stressing of the contact 15 beyond its elastic limit that could otherwise damage the same. Another feature of the three-dimensional cantilever contact arrangement of the invention is that the electrical connection of the cantilever contacting portion 44 and the pin contact 80 can be made with the burr-free side of the pin contact. (As is known, pin contacts 80 sometimes are made by stamping the same from rolled stock, and it is desirable to effect electrical connections with the burr-free side of such contacts.)

Another feature of the contacts 15 and the use thereof in the preferred cable termination assembly just described is that the offset 55 in each contact blocks and prevents insertion of the leading end of a pin contact 80 beyond such offset bend. The strength of such blocking function further is enhanced by the molded material of the strain relief body 17 behind such offset 55. Such blocking function prevents a pin contact 80 from being inserted too far into a cell 20 such that the pin contact might penetrate the insulation of the cable 12 and cause a short circuit with one or more of the cable conductors.

Additionally, in view of the nature of a cantilever-type contact and of the support provided by the wall 37 to prevent over-stressing of the contact, the contacts 15 will have a relatively high level of compliance. Thus, a cable termination assembly 10 in accordance with the invention would be able to tolerate a relatively large degree of mis-alignment or mis-positioning of pin contacts 80 inserted into the respective cells 20 and will be able to accept a relatively large range of sizes of pin contacts, both in terms of cross-sectional size (due to compliance of the contact) and contact length (due to the stop function provided by the offset bend 55).

While the invention is illustrated and described above with reference to multiconductor electrical cable termination 11 located at an end of the multiconductor electrical conductor 12, it will be apparent that such a termination also may be provided in accordance with the invention at a location on a multiconductor electrical cable intermediate the ends thereof.

Although the invention has been shown and described with respect to a particular preferred embodiment, it is obvious that equivalent alterations and modification will occur to others skilled in the art upon the reading and understanding of this specification. Thus, for example only, although the invention has been illustrated and described with respect to a socket type connector, it will be appreciated that features of the invention may be employed in card edge and other types of connectors. Also, the junctions 21 may be other than IDC junctions, such as soldered connections, welded connections, and so on. Further, the contacts 15 may be fork contacts or other contacts that are two dimensional or three dimensional. Additionally, the relation of the contacts 15 with cells 20 may be other than the cooperation of the base 41 and offset 55 thereof with opening 34 to provide the shut off function for a contact containing cell; but, preferably, there should be a cooperative relation of the contact 15 with the cap 16 to effect such shut off.

The present invention includes all equivalent alterations and modifications, and is limited only by the scope of the following claims.

STATEMENT OF INDUSTRIAL APPLICATION

With the foregoing in mind, it will be appreciated that the cable termination assembly, contact and method described in detail above and illustrated in the drawings may be used to effect electrical interconnections in the electrical and electronics arts.

We claim:

1. A cable termination assembly, comprising an electrical cable including at least one conductor, at least one electrical contact, support body means for supporting said electrical contact, and strain relief body means directly molded to at least part of said cable, said electrical contact and said support body means to form an integral structure therewith; said electrical contact having a connection portion for connecting with a said conductor to form a junction therewith, a contacting portion for contacting with an external member when in engagement therewith, and a base portion between said connection and contacting portions; said support body means including wall means for defining a chamber for said contacting portion, external opening means for permitting insertion of an external member into said chamber for electrical connection with said contacting portion, land means for supporting said base portion and positioning means for cooperating with said contact to position said contacting portion of said electrical contact properly in said chamber; said base portion of said contact including offset means of a width and length sufficient to cooperate with said land means in said support body for closing an end of said chamber opposite said external opening means; and said strain relief body means being molded against said offset means at a side thereof opposite said external opening means and over said connection portion and said junction.

2. The assembly of claim 1, wherein said connection portion comprises insulation displacement connection means for IDC connecting with said conductor.

3. The assembly of claim 1, wherein said contact has a wall thickness less than a corresponding dimension of said chamber, and is bent to form said offset means having said length and width dimension at least equal to corresponding dimension of said end of said chambers.

4. The assembly of claim 1, comprising a plurality of electrical contacts, and wherein said cable includes a plurality of conductors connected to respective contacts at respective junctions encapsulated by said strain relief body means.

5. The assembly of claim 4, wherein said cable comprises a multiconductor flat cable.

6. The assembly of claim 1, wherein said electrical contact comprises a three-dimensional contact.

7. The assembly of claim 6, wherein said three-dimensional contact comprises a U-shape contact having a support arm and cantilever contacting portion.

8. A method of making a cable termination assembly, comprising the steps of placing an electrical contact in a support body portion of the assembly with a contacting portion thereof located in a chamber in the support body portion, the contact also having an insulation displacement connection portion for connection with a conductor to form a junction therewith and a base portion, between the contacting and connection portions positioned to close an end of said chamber, supporting the base portion by a land forming at least a part of the wall of the chamber in the support body portion, effecting insulation displacement connection of an electrical conductor with the insulation displacement connection portion of the electrical contact, and directly molding a strain relief body to the connection portion of the electrical contact, the junction, the portion of the electrical contact closing an end of said chamber, and the support body portion.

9. The method of claim 8, wherein there are a plurality of electrical contacts and electrical conductors, and said insulation displacement connection effecting step comprises effecting substantially simultaneously insulation displacement connection of a plurality of the electrical contacts with respective electrical conductors, and said molding step comprises molding the strain relief body directly to at least the part of the electrical contacts blocking an end of the chambers for the contacting portions, the support body portion and the conductors.

* * * * *